United States Patent [19]

Frederick

[11] 4,075,858

[45] Feb. 28, 1978

[54] HYDRAULIC PILE DRIVING APPARATUS AND METHOD

[76] Inventor: Leonard L. Frederick, 15 Crestview Terrace, Whippany, N.J. 07981

[21] Appl. No.: 687,195

[22] Filed: May 17, 1976

[51] Int. Cl.[2] ..... E02D 7/10

[52] U.S. Cl. ..... 61/53.5; 173/125; 173/131; 173/DIG. 1

[58] Field of Search ..... 61/53.5, 63; 173/125, 173/127, 131, DIG. 1; 92/169

[56] References Cited

U.S. PATENT DOCUMENTS

| | | | |
|---|---|---|---|
| 3,817,335 | 6/1974 | Chelminski | 61/53.5 X |
| 3,881,557 | 5/1975 | Gendron et al. | 173/131 |
| 3,939,922 | 2/1976 | Swenson | 173/125 |
| 3,958,647 | 5/1976 | Chelminski | 173/131 X |

*Primary Examiner*—Jacob Shapiro
*Attorney, Agent, or Firm*—Edwin E. Greigg

[57] ABSTRACT

An apparatus and a method for driving piles onshore or offshore, including driving a tubular pile within a submersed tubular jacket leg of an offshore structure and field disassembly.

The apparatus hammer includes a displaceable ram structure, mounted within a pressurized air-filled housing, which is reciprocated by a pressurized working liquid against a pile-engaging anvil structure, which is in dry contact with a pile inserted within one end of the pressurized housing. The ram structure compresses air within the housing near the end of its firing stroke to preload the anvil structure for better energy transfer to the pile. The ram structure also compresses the air within the housing near the end of its loading stroke to slow the ram structure and permit full charging of working liquid accumulators, which discharge during the firing stroke to maintain working liquid pressure and prevent cavitation.

Pressurized working liquid and air are supplied to the hammer from a rotatable and longitudinally displaceable platform having an extendible mounting spider structure for mounting to an offshore structure and including hoist means for inserting and positioning the hammer within a jacket leg.

Alternately, the pressurized working liquid system can be self-contained in the hammer by mounting electrically-driven hydraulic pumps in the hammer.

The hammer structure includes a packing gland capable of withstanding high impact loads, which is locked into place by a locking taper joint, and which is easily removed by sequential and selective application of heat and cold.

34 Claims, 5 Drawing Figures

HYDRAULIC PILE DRIVING APPARATUS AND METHOD

BACKGROUND OF THE INVENTION

1. Field of the Invention

The present invention relates to the field of equipment for driving a pile member, and more particularly to a hammer and associated equipment for driving a pile member from an offshore installation, and to a method for producing a reciprocating impact load against a submersed pile member, as well as to a method of field assembly and disassembly of a hammer.

In the pile driving equipment field, there is always a need for equipment that can withstand high impact shock loads for long periods of time with minimal maintenance. It is also desirable that such equipment be easily and quickly disassembled and reassembled in the field for maintenance or replacement of component parts. The present invention fulfills such needs.

In offshore pile-driving equipment, there is always a need for hammers and associated equipment which can be quickly and easily installed and removed from an offshore installation. There is also always a need for pile-driving hammers which can efficiently operate when submersed in deep water, i.e., at depths of several thousand feet, and still develop a high rated striking force. The present invention also fulfills these needs.

2. Description of the Prior Art

The pile-driving hammer of the present invention is similar to that disclosed in the U.S. Pat. No. 3,927,722, for a pile-driving hammer, issued on Dec. 23, 1975 to myself, Leonard L. Frederick. Both utilize a stationary main valve means for the working fluid, which is disposed within a reciprocating ram structure on a stem member which is in sealing, sliding contact with the reciprocating ram structure. Both have top and bottom compression chamber means for respectively decelerating the ram structure at the end of its loading stroke, and preloading an anvil structure just before it is struck by the ram structure. Both have means for enveloping the end of the pile member in pressurized air to assure that the driving impact against the pile member takes place in air, rather than in water.

The hammer described herein can be used for any application for which the hammer described in U.S. Pat. No. 3,927,722 is used; however, the reverse of this statement of interchangeability does not apply, since the hammer disclosed herein is capable of efficiently operating at much greater depths than the hammer disclosed in U.S. Pat. No. 3,972,722.

The hammer disclosed in U.S. Pat. No. 3,927,722 uses compressed air as its working fluid, and thus is limited as to operating depth to a few hundred feet, whereas the hammer disclosed herein uses pressurized liquid as its working fluid, which is not only over twice as efficient as air, but can be operated at higher pressures, thus allowing the use of a smaller hammer and working fluid supply lines than the referenced air operated hammer for the same striking force, and efficient operation in a range of water depths up to 4000 feet.

Also, the quantity of high pressure air required to prevent entrance of water into the hammer disclosed herein is minimized because it is not mixed with the working fluid, as is the case with the referenced air operated hammer.

The hammer disclosed herein uses a single, push-rod sliding valve means to control the position of the main valve, whereas the referenced hammer requires two cam-operated ball valves. Also, the main valve for the working fluid in the hammer disclosed herein is simpler than the equivalent valve of the referenced hammer, since it only controls the admittance and exhaust of working liquid to the firing chamber for the ram structure, rather than to both the loading and firing chambers for the ram structure, as does the referenced hammer. Also, the further valve means of the referenced hammer, which connect the loading chamber with the top compression chamber, is not required in the hammer disclosed herein.

Also, a unique packing gland for sealing the top end of the ram structure, which is secured to the ram structure by a locking taper joint, and easily assembled and disassembled in the field, is disclosed herein. whereas the referenced known hammer uses conventional closure means.

OBJECTS AND SUMMARY OF THE INVENTION

It is a general object of the present invention to provide the present state of the art with a unique pile driving hammer and associated apparatus which satisfies the needs expressed above.

It is a related general object of the present invention to provide a method of producing a reciprocating impact load against a pile member by a liquid-actuated pile driving apparatus which satisfies the needs expressed above.

It is a related specific object of the present invention to provide a unique rod packing gland for the rod end of a hydraulic cylinder, capable of continuously withstanding high impact forces up to 5000 g. as well as a method of easily removing and replacing this packing gland at a field location using commonly available tools.

It is still another object of the present invention to provide a liquid-operated hammer with a self-contained working liquid system to thereby eliminate the need for long, hydraulic hoses from a surface supply to the hammer.

It is a further object of the present invention to provide an operating platform which includes pressurized working liquid and air supply equipment and hoist equipment for operating and positioning the hammer, and which has adjustable structures for mounting and positioning the platform at an offshore installation.

Still another object of the present invention is to provide a method of excluding all water from the end of the hammer into which the pile member to be driven extends.

It is a still further object of the invention to provide a pressurized working liquid accumulator, which alternately operates in both the supply and return working liquid circuits, thereby reducing transient working liquid requirements and preventing cavitation.

It is yet another object of the present invention to provide a stationary main control valve mechanism for the working liquid disposed within a reciprocating ram structure.

A still further object of the present invention is to provide a hammer having a reciprocating ram structure with compression chambers for a gaseous fluid at both ends of the stroke of the ram structure, one of the compression chambers slowing the ram structure during its loading stroke to allow the full charging of high pressure working liquid accumulators, and the other of the compression chambers exerting a pre-load force on an anvil structure in contact with a pile member before impact by the ram structure.

It is yet another further object of the present invention to provide a packing gland around the anvil structure to prevent splashing water from destroying the lubrication thereon.

It is also an object of the invention to provide a hammer with centralizing springs mounted on the external surface of the hammer which automatically center the hammer as it progresses down the jacket leg of an offshore structure.

These and other objects are accomplished according to the present invention by the provision of a pile driving hammer which includes a reciprocating ram structure, slidably disposed within a pressurized gas-filled housing, which is moved upwards for loading, and downwards for firing against an anvil structure which rests on a pile member extending into a bottom guide sleeve which is also filled with pressurized gas. The pressure of the gas within the housing and guide sleeve is regulated to be approximately equal to the pressure exerted on the lowermost part of the hammer by the water or other medium surrounding the hammer, to insure that the guide sleeve is always completely filled with pressurized gas.

A stationary piston structure extends through a top opening in the ram structure and defines loading and firing chambers within a recessed space of the ram structure. The top end of the ram structure carries a packing gland which seals against a stem portion of the piston structure and is secured to the ram structure by a locking taper joint. High pressure working liquid is continually directed against a bottom-facing surface of the ram structure defining the loading chamber to exert a force on the ram structure to move it upwards. As the ram structure approaches its topmost position, it contacts and moves a push-rod valve, which in turn, operates a main valve within the piston structure which allows a high pressure liquid to be directed against a top-facing surface of the ram structure defining the firing chamber which is larger in area than the above-mentioned bottom-facing surface, so that the net force exerted on the ram structure is one tending to move the ram structure downward in cooperation with the ever-present gravitational force on the ram structure.

As the ram structure approaches its striking position, it again contacts and moves the push-rod valve to close the main valve admitting high pressure working liquid into the firing chamber, and to connect the firing chamber to a low pressure working liquid return manifold, whereupon the continuous force exerted on the bottom facing surface of the loading chamber moves the ram structure upward after striking the anvil structure.

As the ram structure approaches its topmost position, it compresses the gas within an upper compression chamber of the hammer housing, which slows the ram structure, and allows high pressure liquid accumulators, connected to a high pressure manifold supplying the main valve, to fully charge. As the piston moves downward toward the anvil structure, these high pressure liquid accumulators supply additional pressurized working liquid to maintain a high pressure within the firing chamber and to prevent cavitation.

As the ram structure approaches the anvil structure, it compresses the gas within a lower compression chamber of the hammer housing, to preload the anvil structure for optimum energy transfer to the pile member when the ram structure strikes the anvil.

A liquid accumulator contained within the piston structure and connecting with the firing chamber, acts in both the high and low pressure working liquid circuits, as the firing chamber is connected to one or the other.

The source of high pressure working liquid can either be a hydraulic pump located at the surface and connected to the hammer by hydraulic supply and return hoses, or electrically driven hydraulic pumps contained within a separate pressurized gas-filled compartment of the hammer, which is connected by a submersible electric power cable to an electric power source at the surface.

Surface auxiliary apparatus for the hammer includes a platform having an adjustable mounting spider structure for mounting to structural members of an offshore tower or structure. One end of the platform is shaped to correctly position the platform against a jacket leg through which a pile is to be driven, and the platform can be moved along a longitudinal axis or rotated relative to its mounting structure. The platform includes hydraulic hoists for the hammer, and air and hydraulic pumps to supply pressurized air and working liquid to the hammer. The hydraulic pumps are also used to power the hydraulic hoists, torque motors for the air and hydraulic hoses, and platform positioning hydraulic cylinders.

Other objects and advantages of the present invention will be more readily apparent from a further consideration of the following detailed description of the drawings illustrating preferred embodiments of the invention, in which:

DESCRIPTION OF THE PREFERRED EMBODIMENTS

Figure 1:
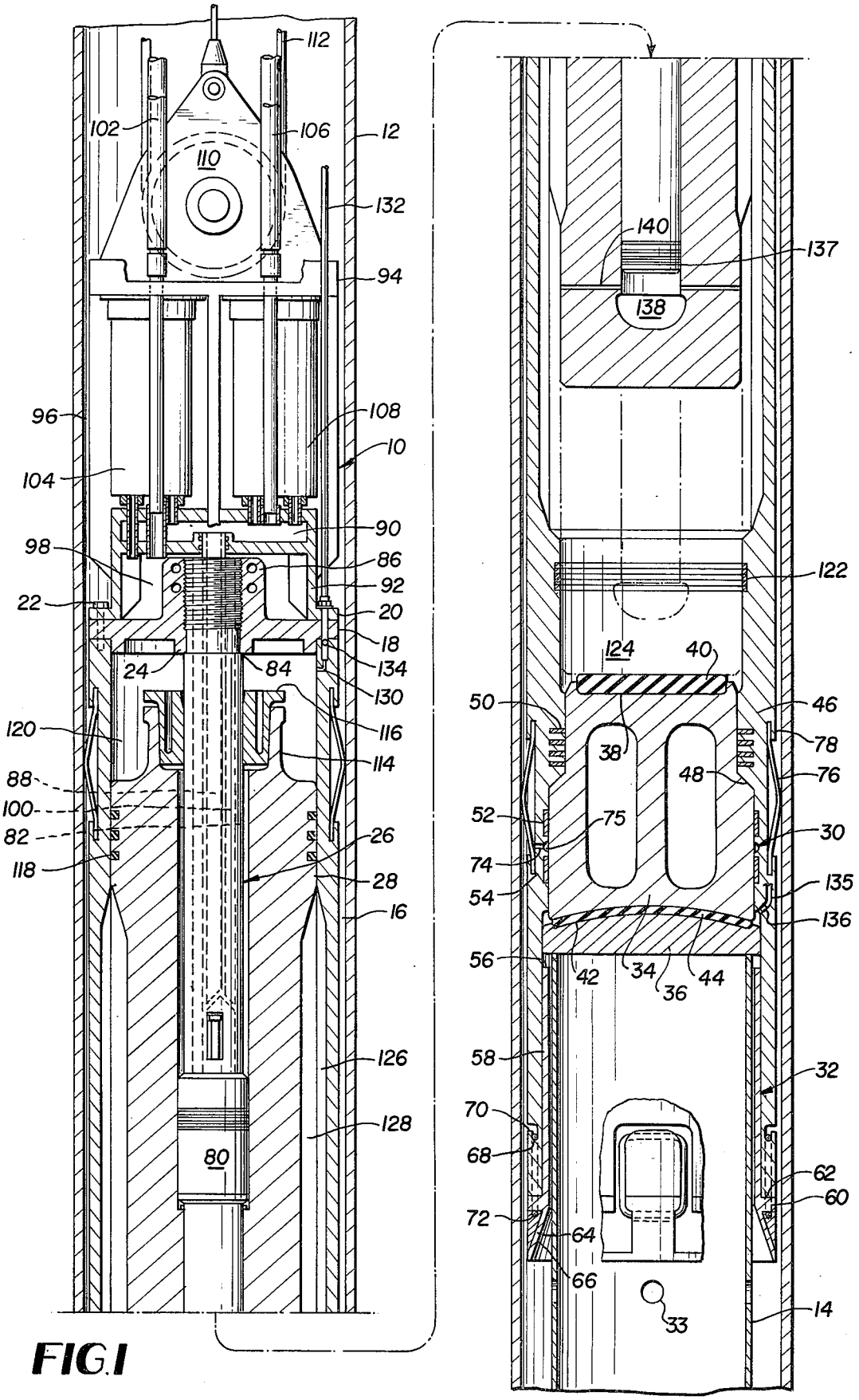
FIG. 1 is a partial longitudinal cross-sectional view taken through a pile driving hammer according to the present invention.

Turning to FIG. 1, there is shown a pile driving hammer 10, disposed within a jacket leg 12, for driving a tubular pile member 14. The pile driving hammer 10 includes a heavy elongated outer cylinder forming a housing member 16, through one end of which the pile member 14 is received. At the other end of the housing member 16, a closure plate 18 and a frame member 20 is fastened by a plurality of fastening bolts 22. The closure plate 18 includes a central opening 24 through which one end of a stationary piston structure 26 passes for mounting within the pile driving hammer 10. An elongated cylindrical ram structure 28 and an anvil structure 30 are mounted within the housing member 16 for longitudinal displacement relative to the housing member 16. In its rest position, the ram structure 28 is supported by the anvil structure 30, while the anvil structure 30 either engages the pile member 14, or it engages and is supported by a guide sleeve 32.

While the pile member 14 shown in FIG. 1 is a cylindrical pile member, it should be understood that any configuration of a pile member can be driven by the pile driving hammer 10. However, when the pile member driven by the pile driving hammer 10 is a tubular pile member, such as the pile member 14, it must include at least one opening in the side of the pile member which is located approximately at the lower end of the guide sleeve 32, to provide an exit for the water contained within the tubular pile member 14 when the pile member 14 is driven downward by the anvil structure 30. Otherwise, a portion of the energy transmitted by the anvil structure 30 would be used to move a column of water within the pile member 14 between the surface of the water at the entrance to the guide sleeve 32 and the anvil structure 30, thus reducing the portion of the energy transmitted to the pile member 14.

The anvil structure 30 includes an anvil block 34, which is displaceably mounted within the lower portion of the housing member 16, and an alignment plate 36. At the top surface of the anvil block 34, there is provided a depression 38 into which a cushion plate 40 is mounted. At the top surface of the alignment plate 36, there is provided a depression 42 into which a cushion plate 44 is mounted. The depression 42 and the cushion plate 44 are preferably configured to have convex surfaces. The bottom surface of the anvil block 34 is concavely shaped in order to match the convex surface of the cushion plate 44. The cushion plates 40 and 44 are preferably made from a ductile material, such as aluminum.

In the area of the anvil structure 30, the housing member 16 is provided with a shoulder portion 46 which defines an inclined abutment surface 48, which is engaged by a mating surface on the anvil block 34 when the pile member 14 is in position as shown in FIG. 1. Within the wall of the shoulder portion 46, there are included a plurality of contracting seal rings 50, while in the enlarged diameter portion of the housing member 16 below the shoulder portion 46 there are provided two sets of adjacent V-seals 52 and 54.

When the alignment plate 36 is not in engagement with a pile member, it rests against a surface 56 of the guide sleeve 32.

The guide sleeve 32 includes an extended portion 58, one end of which defines the surface 56 and at the other end of which a flange portion 60 extends horizontally outwardly. The flange portion 60, in turn, defines an abutment surface 62 which engages the bottom surface of the housing member 16. A truncated cone portion 64 extends downwardly from the flange portion 60 and defines a guide surface 66 which guides the pile member 14 into the housing member 16 and into engagement with the abutment plate 36. The guide sleeve 32 is mounted to the housing member 16 by preferably four equally spaced wire rope slings 68 which are looped around flush hooks 70 formed in the body of the housing member 16 and channels 72 formed in the body of the guide sleeve 32. The flush hooks 70 and the channels 72 define aligned pairs of channel portions. The flush hooks 70 may be provided with safety wire holes (not shown) to ensure retention of the rope slings 68.

The housing member 16 includes a duct 74, which connects to a lubrication grease through fitting (not shown) at one end, and to an annular space 75 defined by the inner wall of the housing member 16 between the V-seals 52 and 54, at an opposite end, to provide lubrication for these seals 52, 54 and the anvil friction surface.

For guiding the pile driving hammer 10 within the jacket leg 12, a suitable number of centering springs 76 are fastened to the outer surface of the housing member 16 at both an upper and lower station. The centering springs 76 are mounted to the outer surface of the housing member 16 by slots 78 into which the ends of the centering springs are received and retained.

The piston structure 26 includes a main body portion 80 and an elongated stem portion 82, which is preferably an integral extension of the main body portion 80. The stem portion 82 has a shoulder 84 which abuts against the underside of the closure plate 18 and serves as a stop in the assembly of the stem portion 82 to the closure plate 18. That portion of the stem 82 immediately above the shoulder 84 is preferably threaded for engagement with the threads provided on the inner surface of a split sleeve portion of the closure plate 18, and locked therein by fastening bolts 86.

A center end portion of the stem portion 82, which defines an opening to a first interior passage 88 of the piston structure 26 beyond the closure plate 18 extends through a portion of the frame member 20 into a high pressure manifold chamber 90 described hereinafter in further detail. This first passage 88 of the piston structure 26 extends from the high pressure manifold chamber 90 centrally through the stem portion 82 into the main body portion 80 of the piston means 26.

The frame member 20 has a lower end 92 and an upper end 94 connected together by four orthogonally intersecting plate portions 96 which are shown only in outline in FIG. 1 so that other elements disposed in the four quadrants defined by the cross-shaped central portion of the frame member 20 can be illustrated. As previously discussed, the lower end 92 of the frame member 20 is connected to the closure plate 18 and the housing member 16 by a plurality of mounting bolts 22. This lower end portion 92 is recessed to form, with the closure plate, a low pressure manifold chamber 98 which connects with a second interior passage 100 of the piston structure 26, which extends from the low pressure manifold chamber 98 through the stem portion 82 into the main body portion 80. In the stem portion 82, this second passage 100 is annular in shape, and concentric with the first passage 88. The low pressure manifold chamber 98 also connects with a return liquid line 102 and a plurality of liquid accumulators 104, which are mounted between the two ends 92, 94 of the frame member 20.

The lower end 92 of the frame member 20 also defines a high pressure manifold chamber 90, which, as previously discussed, connects with the first passage 88 of the piston structure 26. This chamber 90 also connects with a supply liquid line 106 and a plurality of high pressure liquid accumulators 108, which are also mounted between the two ends 92, 94 of the frame member 20.

A pair of support cable sheaves 110 are rotatably mounted to the upper end portion 94 of the frame member 20, and engage with cables 112 which support the hammer 10.

The ram structure 28 is closed at its lower end and opened at its upper end. At its upper end, the ram structure 28 has an extending neck portion 114 into which a packing gland 116 is mounted, as discussed in further detail hereinafter, with reference to FIG. 2. The ram structure 28 also has contracting seal rings 118 disposed near its outer upper end which seal against the upper inner surface of the housing member 16, as seen in FIG. 1, when the ram structure 28 approaches its topmost position to form a top compression chamber 120.

Similarly, there are mounted V-seals 122 within a lower portion of the inner wall of the housing member 16, which seal against the ram structure 28 as the ram structure approaches its lowermost position, as seen in dashed lines in FIG. 1, to form a bottom compression chamber 124, defined by the ram structure 28, the housing member 16, and the anvil structure 30.

Within a median portion of the inner wall of the housing member 16, there are formed a plurality of longitudinally extending grooves or flutes 126, which provide a bypass passage for gaseous fluids between the top and bottom ends of the ram structure 28 during a median portion of its travel. Similar longitudinally extending grooves 128 are formed in a median portion of the outer surface of the ram structure 28 for the same purpose.

A passage 130, formed within the upper portion of the housing member 16 and passing through the closure plate 18 and the frame member 20, opens into the top compression chamber 120 at one end, and connects with a pressurized air supply line 132 at an opposite end. The portion of this passage 130 passing through the closure plate 18 constitutes a valve seat for a check valve 134 which closes when the air pressure within the top compression chamber 120 exceeds the air pressure within the air supply line 132.

The housing member 16 includes a longitudinal groove into which an air line 135 extends from a recessed space 136, within the housing member 16, into which the alignment plate 36 extends, to the air supply line 132, preferably through a check valve 136 which closes to prevent entrance of water into the housing member 16, in case of a reduction of air pressure therein. Alternatively, the line 135 can extend from this recessed space to one of the grooves 126 within an inner median portion of the housing member 16.

The air line 135 supplies pressurized air to completely fill the guide sleeve 32, and thus assure that the pile driving operation of the hammer 10 is always performed in air, rather than water. As discussed in further detail hereinafter, the pressure of the air supplied to the hammer 10 is regulated at the surface to be maintained at approximately the pressure exerted on the lowermost part of the hammer 10, that is, the entrance to the sleeve guide 32, by the water surrounding the hammer 10.

On a lower portion of the main body portion 80 of the piston structure 26, there are mounted contracting seal rings 137 which seal against the inner surface of the ram structure 28. A lower chamber 138, defined by the lower end of the main body portion 80 of the piston structure 26 is connected with a plurality of grooves 126 formed on the inner surface of the housing member 16 through a plurality of openings 140.

Figure 2:
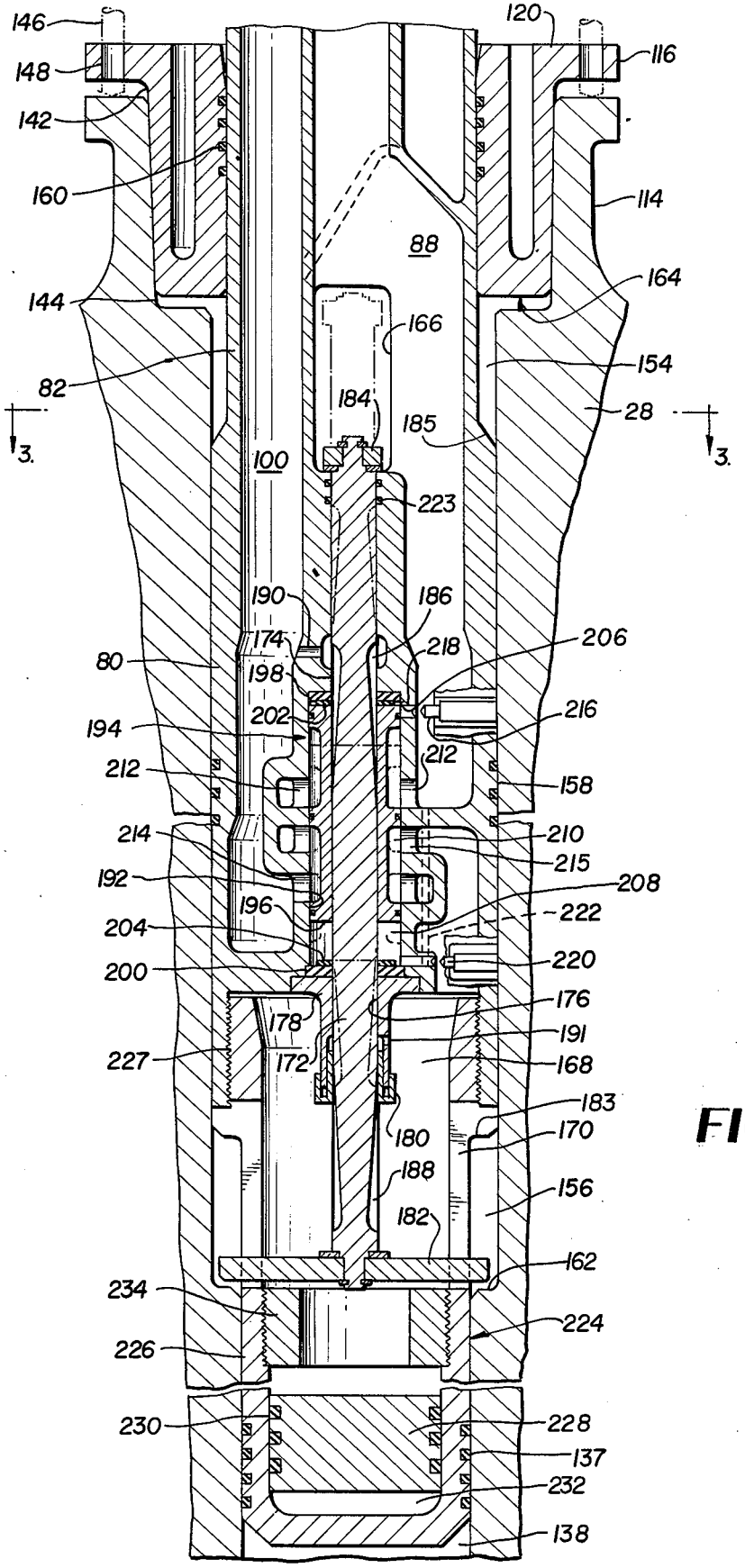
FIG. 2 is a cross-sectional view illustrating further details of the piston structure and packing gland according to the present invention.

Referring now to FIG. 2, the packing gland 116 is locked to the ram structure 28 by the surface friction of the ground surfaces 142, 144 of the packing gland 116 and the ram structure 28. This type of juncture, commonly known as a locking taper joint, requires no further sealing devices such as the conventional "O" rings or "V" packing, and will not only hold in place against the applied hydraulic force without any threaded or keyed parts, but will also be wedged tighter when the ram structure 28 strikes the anvil structure 30. Further, this packing gland 116 can be easily removed in the field with common tools.

To remove the locked-in packing gland 116, threaded jackoff bolts 146, shown by dashed lines in FIG. 2, are set through threaded holes 148 in the outer flange of the packing gland 116 against an upper flanged portion of the ram structure 28. A high rate of heat is then applied to the necked portion 114 of the ram structure 28 to expand this necked portion 114 and the adjoining portion of the gland 116. After sufficient expansion has occurred, cold water is poured into the cavity 150 of the packing gland 116, instantaneously contracting the gland 116 and freeing the locked surfaces 142, 144 which are under tension caused by the force exerted by the jackoff bolts 146 against the ram structure 28.

Within the internal space of the ram structure 28, the piston structure 26 defines a loading chamber 154 and a firing chamber 156. To insure that an effective fluid shield is provided between these chambers 154, 156, contracting steel rings 158 are mounted with the wall of the main body portion 80. The packing gland 116 also includes contracting steel rings 160, mounted within the wall forming the through-bore of the gland 116, which seal against the stem portion 82 to insure an effective fluid seal between the loading chamber 154 and the top compression chamber 120. At the lower end of the main body portion 80, contracting steel rings 137, previously described, provide a fluid seal between the firing chamber 156 and the lower chamber 138.

The effective area of the top-facing surface 162 of the ram structure 28 within the firing chamber 156 against which hydraulic pressure can be applied to move the ram structure downwards is greater than the effective area of the bottom-facing surface 164 of the packing gland 116 against which hydraulic pressure can be applied to move the ram structure 28 upwards.

The loading chamber 154 is connected at all times with the first passage 88 through the two, diametrically opposite, slots 166 in the outer wall of stem portion 82. Similarly, the firing chamber 156 is connected with a third interior passage 168 of the piston structure 26 through the two slots 170 in the outer wall of the main body portion 80 of the piston structure 26.

The main body portion 80 includes a centrally disposed push rod 172, mounted within the main body portion 80 for limited motion along its longitudinal axis between a raised and a lowered position. At its upper end, the push rod 172 is positioned within an upper close fitting bore 174 of the main body portion 80, with the topmost portion of the rod 172 extending at all times into the first passage 88. At its lower end, the push rod 172 is positioned within a lower close fitting bore 176 of a hub member 178 which is bolted to the main body portion. Also, the rod 172 is held by a brass friction nut 180 which is threaded for engagement with threads provided on an end bore surface of the hub member 178, with the bottom-most portion of the push rod 172 extending at all times into the third passage 168 of the piston structure 26.

A bottom crossarm member 182, fastened to the bottom end of the rod 172, has opposite ends, each of which extend through a respective one of the slots 170 into the firing chamber 156 so that, when the rod 172 is in its lowered position and the ram structure 28 is moving upwards in its loading direction, during the last portion of upward travel of the ram structure 28, the crossarm 182 is engaged by the ram shoulder 162 and moved upward to its raised position, shown in dashed lines in FIG. 2. Each of the slots 170, at its upper ends, passes through a shoulder 183 of the main body portion 80 defining the firing chamber 156. At its topmost position, the crossarm member 182 is disposed within the shoulder 183. Thus, in case of overtravel of the ram structure 28 in its upward direction, the crossarm member 182 is protected from being bent by the ram structure 28, which will instead strike against the shoulder 183.

In like manner, a top crossarm member 184, which is similar to, or can even be identical with, the bottom crossarm member 182, is fastened to the top end of the rod 172, with each of the opposite ends of the top crossarm member 184 extending through a respective one of the slots 166 into the loading chamber 154, so that, when the rod 172 is in its raised position and the ram structure 28 is moving downwards in its firing direction, during the last portion of the downward travel of the ram structure 28, the packing gland shoulder 164 engages the top crossarm member 184 and moves the rod 172 to its lowered position. The top crossarm member 184 is protected from being bent by the ram structure 28, in case the ram structure 28 should overtravel in its downward direction, by a shoulder 185 of the main body portion 80, in the same manner that the bottom crossarm member 182 is protected.

In FIG. 2, a center portion of the ram structure 28 has been removed so that both the top and bottom portions of the ram structure 28 could be depicted in their respective operative positions for moving the rod 172 to its raised or lowered position. During an intermediate position of the ram structure 28 between the two positions depicted in FIG. 2, when the ram structure 28 is moving downward and the rod 172 is in its raised position, the friction nut 180 holds the rod 172 and prevents it from freely falling to its lowered position.

The outer surface of the rod 172 defines an upper slot 186 which extends longitudinally along an upper portion of the rod 172, and a lower slot 188 which extends longitudinally along a lower portion of the rod 172. The structure and function of these slots 186, 188 will be discussed in more detail hereinafter.

The main body portion 80 includes an annular groove or recessed space within the upper close-fitting bore 174 which is connected by an upper bore hole 190 to the second passage 100 of the piston structure 26. A similar recessed space between the hub member 178 and the friction nut 180 is connected by a lower bore hole 191 to the third passage 168 of the piston structure 26.

The main body portion 80 also includes a central passage 192 extending longitudinally along the axis of the rod 172 between the upper and lower close-fitting bores 174, 176, within which a main valve 194 for the working liquid is mounted. This main valve 194 includes a displaceable sleeve or spool 196, which is displaceable within the central passage 192 along the rod 172 between an upper cushion 198 and a lower cushion 200. These cushions can be made of a ductile material, such as rubber. To reduce the wear of these cushions 198 and 200, thin contact plates 202 and 204 are provided, which, in turn, are fastened by any conventional means, such as an adhesive, to their respective cushions 198 and 200. The central passage 192, the rod 172, and the spool valve 194 define an upper valve control chamber 206, a lower valve control chamber 208, and a valve chamber 210. Also, the first passage 88 is connected to the central passage 192 through a plurality of annularly spaced first ports 212. In like manner, the second passage 100 is connected to the central passage 192 through a plurality of annularly spaced second ports 214, and the third passage 168 is connected to the central passage 192 through a plurality of annularly spaced third ports 215.

The first passage 88 and ports 212, which are connected to the high pressure manifold chamber 90, constitute a portion of means for delivering high pressure working liquid to the main valve 194. The second passage 100 and ports 214, which are connected to the lower pressure, or exhaust, manifold chamber 98, constitute a portion of the return means for the exhausted working liquid. When the spool 196 is disposed in its raised position, as shown in FIG. 2, the valve chamber 210 connects the third passage 168 with the second passage 100, thus connecting the firing chamber 156 to the exhaust return means. When the spool 196 is disposed in its lowered position, the valve chamber 210 connects the third passage 168 with the first passage 88, thus connecting the firing chamber 156 to the high pressure working liquid delivery means.

The first passage 88 is also connected to the upper valve control chamber 206 through an upper adjustable needle valve 216 and an upper passage 218, and to the lower valve control chamber 208 through a lower adjustable needle valve 220 disposed in a lower passage 222.

When the rod 172 is in its lowered position, or at a point along its path of travel which is closer to its lowered position than to its raised position, the upper slot 186 of the rod 172 will form a connecting passage from the upper valve control chamber 206 to the upper bore hole 190, and hence to the exhaust return second passage 100, while the lower valve control chamber 208 will be sealed from the lower bore hole 191 by the lower close fitting bore 176 in contact with an unslotted portion of the rod 172. This permits the pressure of the liquid in the lower valve control chamber 208, in communication with the high pressure liquid first passage 88 through the lower needle valve 220, to increase, while the pressure of the liquid within the upper valve control chamber 206, in communication with the low pressure liquid return second passage 100 through the upper slot 186 and upper bore hole 190 to remain at the low exhaust pressure. If then, the spool 196 is disposed in its lowered position, the difference in pressure exerted on the ends of the spool 196 by the working liquid in the upper and lower valve control chambers 206, 208 will cause the spool 196 to be displaced to its raised position.

Similarly, when the rod 172 is in its raised position, or at a point along its path of travel which is closer to its raised position than to its lowered position, the lower slot 188 of the rod 172 will form a connecting passage from the lower valve control chamber 208 to the lower bore hole 191, connecting with the third passage 168, while the upper valve control chamber 206 will be sealed from the upper bore hole 190 by a lower portion of the close fitting bore 174 in contact with an unslotted portion of the rod 172. If then, the spool 196 is disposed in its upper position, in which position the third passage 168 is connected to the low pressure liquid return second passage 106, the increasing pressure in the upper valve control chamber 206, working against the low pressure in the lower valve control chamber 208, will cause the spool 196 to move to its lower position.

Since there is always a difference in pressure between the working liquid in the first passage 88 and the upper bore hole 190, contracting seal rings 223 are mounted within the upper portion of the close fitting bore 174, in sealing contact with the push rod 172. While similar rings could be mounted along a median portion of the push rod 172 and within the close fitting bore 176, to seal between the upper and lower valve control chambers 206, 208, and the third passage 168, this is not considered necessary, since the small amount of leakage between the close fitting surfaces therebetween can be compensated by adjusting the needle valves 216, 220.

The main body portion 80 of the piston structure 26 also includes a liquid accumulator 224 mounted at the lower end of the main body portion 80. This liquid accumulator 224 includes a hollow, cylindrical member 226 having a lower, closed end which extends into the lower chamber 138, described above, and an opened opposite end, which is in communication with the third passage 168 of the piston structure 26, and which is preferably threaded for engagement with threads provided on an inner, lower surface 227 of the main body portion 80. Mounted within the interior space of the cylindrical member 226 there is a displaceable piston member 228, having U-cup seal rings 230 mounted with its outside surface, which seal against the inside surface of the cylindrical member 226 to form a further compression chamber 232. A threaded retaining ring 234 is engaged with a threaded upper end portion of the cylindrical member 226 to hold the piston member 228 within the interior bore of the cylindrical member 226 against the force exerted on the piston member 228 by pressurized gas contained within the compression chamber 232. When pressurized liquid is introduced into the open end of the liquid accumulator 224, the force exerted by the pressurized liquid on the piston member 228 displaces the piston member 228 longitudinally downward into the compression chamber 232 against the force exerted on the piston member 228 by the pressurized gas within the compression chamber 232. Then, when the pressure of the working liquid in the third passage 168 decreases, the compressed gas within the compression chamber 232 moves the piston member 228 upwards out of the compression chamber 232, thus increasing the pressure of the liquid in the third passage 168, and in the firing chamber 156 connecting with the third passage 168.

Figure 3:
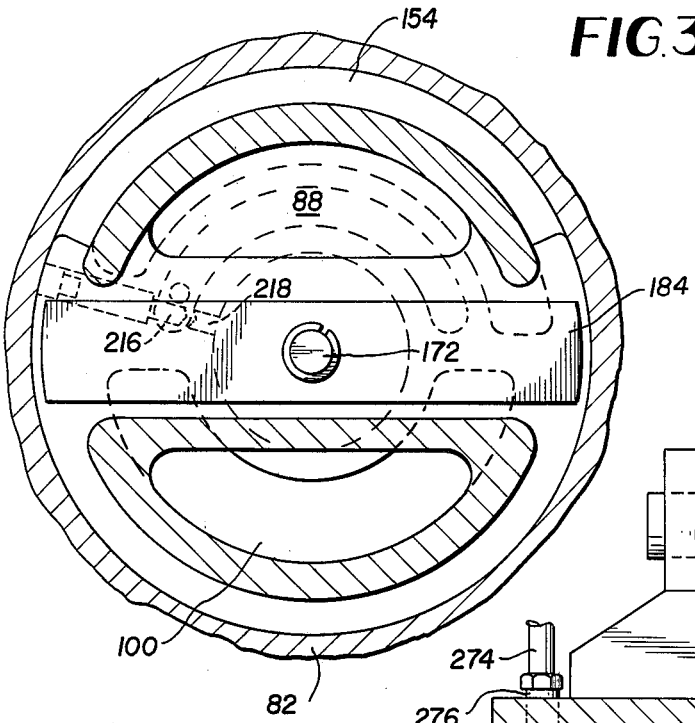
FIG. 3 is a cross-sectional view of the stem portion of the piston structure, taken along line 3—3 of FIG. 2.

In FIG. 2, the needle valves 216, 220, and the passages 218, 222 are shown in a rotated position from their actual position to better explain their operation in relation to other elements of the piston structure 26. As shown by dotted lines in FIG. 3, these elements 216, 218, 220, and 222 are disposed within the main body portion 80 between the first passage 88 and the second passage 100. FIG. 3 also shows the ends of the crossarm member 184 extending into the loading chamber.

Figure 4:
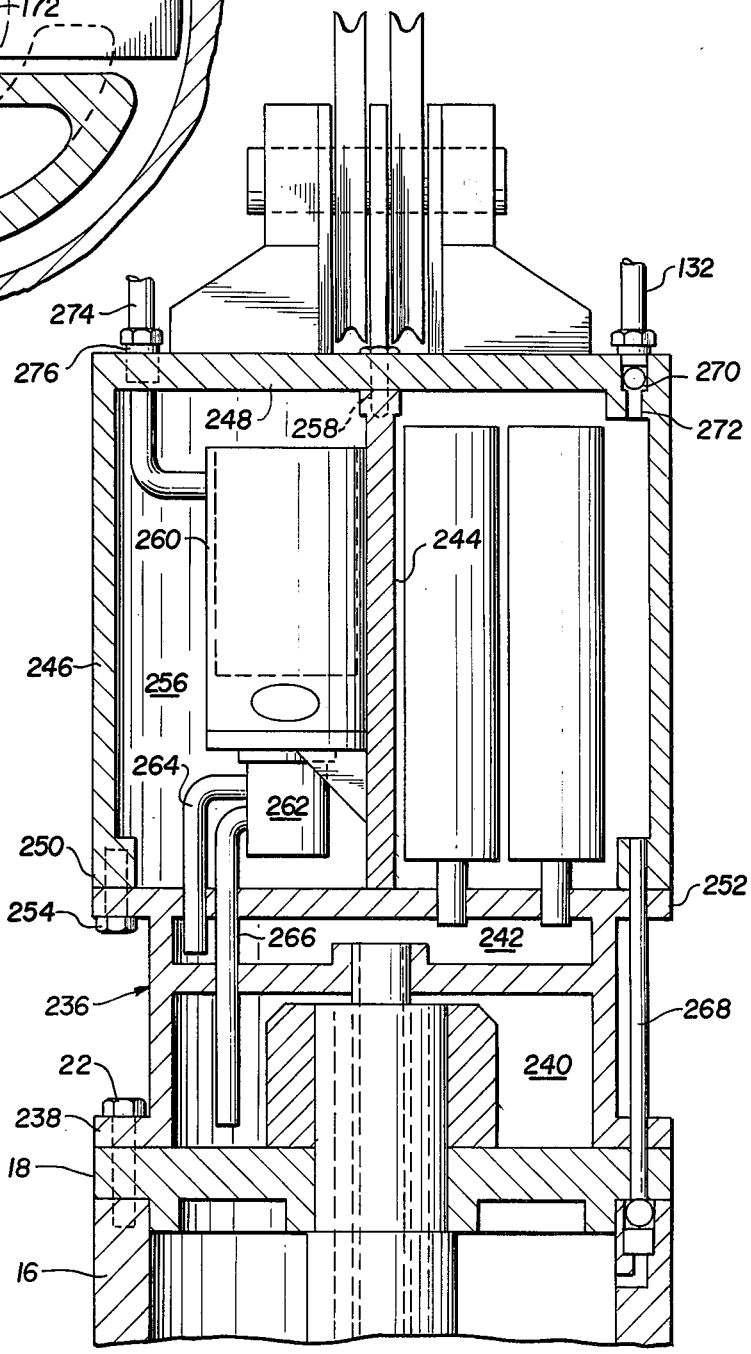
FIG. 4 is a partial cross-sectional view of an upper portion of a pile driving hammer illustrating another embodiment of the invention, in which the hammer includes electrically powered hydraulic pumps.

FIG. 4 illustrates another embodiment of this invention, in which the entire pressurized working liquid system is included on the hammer structure, thus eliminating the necessity for the supply and return hydraulic hoses 102 and 106, as well as the low pressure liquid accumulator 104.

A first frame member 236, similar to the end portion 92 of the frame member 20 in the previously described embodiment of FIG. 2, is attached at its lower flanged end 238, together with the closure plate 18 to the housing member 16 by the plurality of bolts 22. The low pressure manifold chamber 240 defined by the first frame member 236 and the closure plate 18 is identical to the low pressure manifold chamber 98 previously described, except there are no connections to low pressure liquid accumulators. The first frame member 236 also defines a high pressure liquid manifold chamber 242, which is essentially the same as the manifold chamber 90 previously described.

A longitudinally extending, centrally disposed support plate member 244 is welded to an upper end surface of the first frame member 236. A support housing member 246, having the form of a cylindrical tube closed at one end, has a closed top end 248, and an opened flanged lower end 250 which is mounted to a top flange 252 of the first frame member 236 by a plurality of threaded bolts 254 which engage in threaded surfaces in the flanged end 250 of the support housing member 246, to form a top, sealed enclosure 256. The support housing member 246 is also fastened to the support plate member 244 by a plurality of threaded bolts 258 which engage in threaded surfaces in the top side of the support plate member, to provide additional support for the two support cable sheaves 110, which are rotatably mounted to the top end 248 of the support housing member 246.

Three submersible type electric motors 260 are mounted to lateral support plates which, in turn, are welded to the support plate member 244. Each of three hydraulic pumps 262 are mounted to, and driven by, a respective one of the three electric motors 260. Each hydraulic pump 262 is connected to the high pressure liquid manifold chamber 242 by a supply hydraulic conduit 264, and to the low pressure liquid manifold chamber 240 by a return hydraulic conduit 256.

An air supply line 268 extends from the check valve 134 and passage 130 in the housing member 16 and closure plate 18 into the top enclosure 256. The top end 248 of the support housing member 246 includes a check valve 270, which is disposed in a passage 272 connecting with the pressurized air supply hose 132 from the air supply apparatus located above the surface. In the event that the air supply hose 132 ruptures, or any other failure of the air supply occurs, the check valve 270 will close to prevent entrance of water into the enclosure 256.

Electric power is supplied from the surface to the electric motors through a submersible electric cable 274 which enters the top enclosure through a waterproof cable fitting 276.

Figure 5:
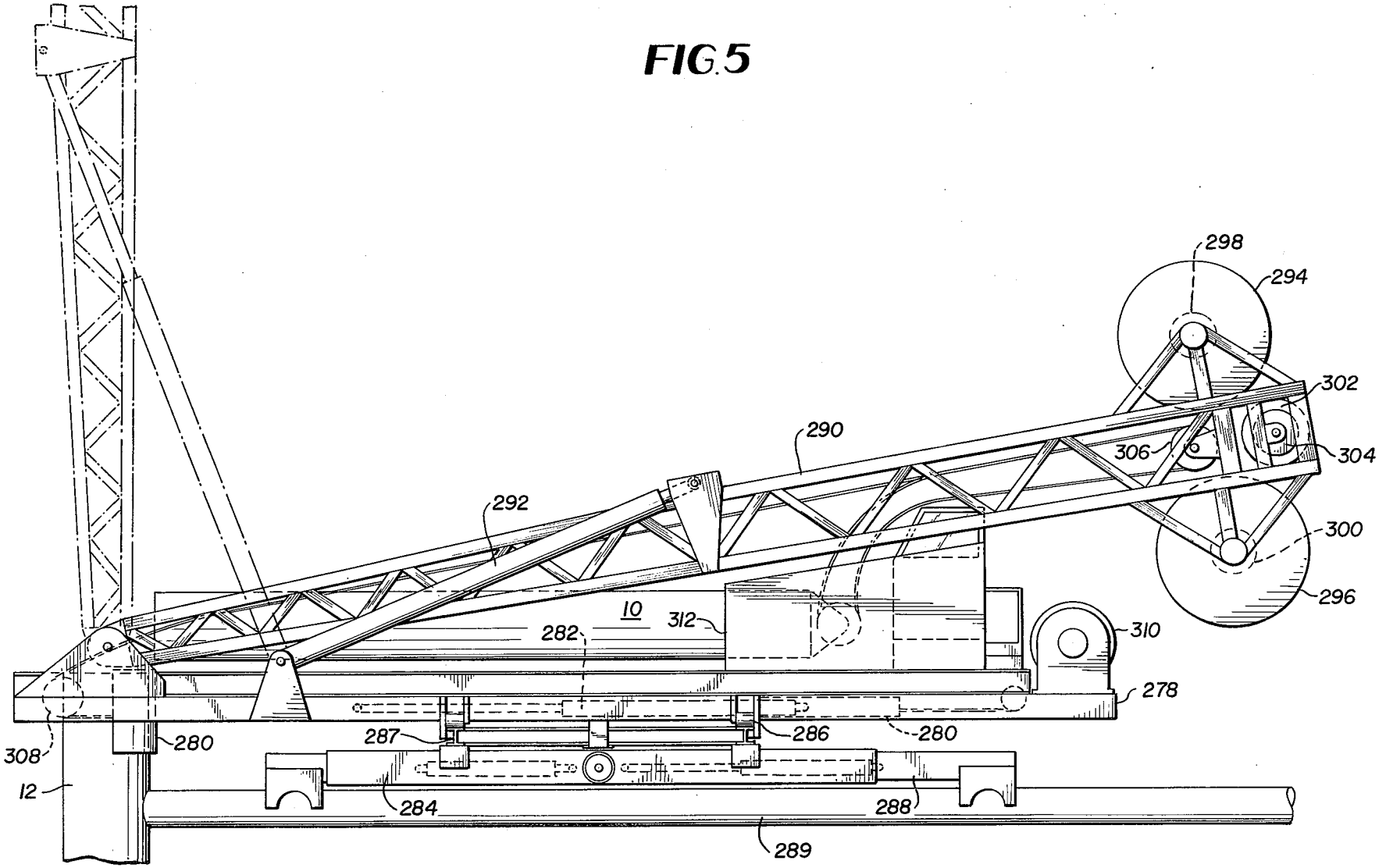
FIG. 5 is a schematic illustration of an apparatus according to the present invention for driving a submersed pile member through a jacket leg of an offshore installation, such as a tower.

Referring now to FIG. 5, there is shown a movable operating platform 278, to which is mounted at one end a semicircular, flanged skirt member 280 which engages the top and side of the jacket leg 12 for properly positioning the platform 278 for inserting the hammer 10, as shown in the embodiment of FIG. 1, into the jacket leg 12.

The platform 278 is supported by a subcarriage structure 280 and can be moved in either direction along a longitudinal horizontal axis of the subcarriage structure 280 by hydraulic cylinders 282, which work between the platform 278 and the subcarriage structure 280.

The subcarriage structure 280 is rotatably supported by a mounting spider structure 284, by rollers 286 which are rotatably mounted to the underside of the subcarriage structure 280, and which engage and roll on the upper flanged surface of a revolving ring member 287 mounted to the mounting spider structure 284. The mounting spider structure 284 also includes extendable leg members 288 having ends which are easily mounted to structural members 289 of the jacket leg 12.

A folding boom structure 290, pivotably mounted to the platform 278, for rotation from a folded non-operating position to a vertical operating position by hydraulic cylinders 292, pivotably mounted to the platform 278 and the boom structure 290 for working therebetween. In its vertical operating position, the boom structure 290 is positioned directly above the jacket leg 12, when the jacket leg 12 is engaged by the skirt member 280.

Hydraulic supply and return hose reels 294, 296, rotatably mounted at the top end of the boom structure 290 and driven by hydraulic torque motors 298, 300, also mounted at the top end of the boom structure 290, carry the supply and return hydraulic hoses 106 and 102, respectively.

Similarly, an air hose reel 302, rotatably mounted at the top of the boom structure 290, and driven by a hydraulic torque motor 304, mounted thereon, carries the pressurized air supply line 132 which is connected through a pressure regulator to a small high pressure air pump (not shown) mounted on the platform 278.

Three cable sheaves 306 are rotatably mounted at the top end of the boom 290, above two other cable sheaves 308 rotatably mounted to the platform 278. The cable 112, which supports the hammer 10, is connected at each end to one of two hydraulic hoists 310 mounted on the platform 278. From one of these hoists 310, the cable passes over a first sheave 308, a first end sheave 306, a first sheave 110 of the hammer 10, a center sheave 306, a second sheave 110, a second end sheave 306, and a second sheave 308 to the other hydraulic hoist 310.

Two hydraulic pumps 312, mounted on the platform 278, not only supply the high pressure working liquid for the hammer 10 through the liquid supply line 106, but also power the hydraulic hoists 310, the hydraulic cylinders 282, 290 and the hydraulic torque motors 298, 300 and 304.

MODE OF OPERATION

The pile driving hammer 10 can be utilized to drive a pile member in either onshore or offshore installations. For the onshore installation, a suitable guide structure such as the leads frame, disclosed in my U.S. Pat. No. 3,747,689, issued July 24, 1973, can be employed. In this case, it is only necessary to supply appropriate guide structure to the housing member 16 so as to make it adaptable for use with the leads frame.

For offshore installations, the operating platform 278, together with the hammer 10, can be carried on board a work barge until needed. Then the platform 278 can be quickly mounted to structural members 289 of an offshore installation by its extendible mounting spider 284, rotated on the flanged revolving ring 287 of the mounting spider 284 until the end of the platform carrying the skirt 280 is facing the jacket leg 12, and moved along the longitudinal axis of the subcarriage member 280 by the hydraulic cylinders 282 which work between the subcarriage 280 and the platform 278, until the skirt 280 properly engages against the jacket leg 12. Next, a pile member 14 is lowered into the jacket leg 12 by the work barge crane. The pile member 14 is equipped with with centering lugs so that it will automatically center itself within the jacket leg 12.

Once the platform 298 has been mounted and positioned, and the pile member 14 placed within the jacket leg 12, the work barge crane is no longer needed and can be used for other purposes. Also, the use of this self-contained operating platform 278 permits the work barge to be hastily moved away from the jacket in the case of a storm or other emergency.

The folding boom structure 290 is raised to its vertical operating position by the hydraulic cylinders 292, and, at the same time, the hammer 10 is raised to a vertical position directly above the jacket leg 12 by the hydraulic hoists 310. The hammer 10 is then lowered into the jacket leg 12 by the two hydraulic hoists 310 and the hydraulic hoses 102, 106 and air hose 132, being attached to the hammer 10, follow it down. As the hammer 10 is lowered, its centering springs 76 automatically center the hammer 10 within the jacket leg 12 so that the guide sleeve 32 at the bottom of the hammer 10 will slip over the head of the pile member 14.

Also, as the hammer 10 is lowered, pressurized air is supplied through the supply air hose 132 from a small high pressure air pump on the platform 278 into the housing member 16 and the sleeve guide 32 through the check valves 134, 136, so that the sleeve guide 32 is always filled with air. This is done by regulating the air pressure so that it is always approximately equal to the pressure exerted on the bottom end of the sleeve guide 32 by the surrounding water. This can be done manually by the operator who adjusts the air pressure in accordance with the depth of the hammer 10, as indicated by one of the hydraulic hoses 102, 106, the air hose 132, or the hammer hoist cable 112, which is marked to show the number of feet lowered into the jacket leg. The play-out of one of these lines can also be measured by a sensing device, which controls the pressure regulator directly, as, for example, a device which senses the angular position and counts the number of revolutions of the hoist drums 310 or one of the reels 294, 296, 302 for the hydraulic or air hoses, or one of the hoist cable sheaves. In any case, the pressure of the air supplied to the hammer 10 should be sufficient to cause a small amount of air to continually issue from the open bottom end of the sleeve guide, which can be observed from the surface by the operator as a small stream of air bubbles rising within the jacket leg 12, thus providing a visual indication to the operator that the guide sleeve 32 is completely filled with air.

As the hammer 10 approaches the pile member 14, the pile member 14 first engages the guide surface 66 and is thereby guided within the guide sleeve 32 and against the bottom surface of the alignment plate 36. The pile driving hammer 10 is lowered over the top of the pile member 14 until the inclined abutment surface 48 of the anvil block 34 is brought into engagement with the corresponding surface on the shoulder portion 46 of the housing member 16. In this position, the ram structure 28 is resting against the top surface of the cushion plate 40, while the bottom surface of the anvil block 34 is resting against the top surface of the cushion plate 44 (FIG. 1). Since the ram structure 28 was in its lowered position while the hammer 10 was being lowered into the jacket leg 12, the push rod 172 is disposed in its lower position, and since no hydraulic pressure has yet been applied, the spool main valve member 196 is disposed in its lower position. The hammer 10 is now ready for operation.

When the operator turns on the hydraulic system, high pressure working liquid is supplied through the hydraulic supply hose 106 into the high pressure manifold chamber 90, and the high pressure liquid accumulators 108 connecting to the high pressure manifold chamber 90 immediately start to charge. At the same time high pressure working liquid is supplied from the high pressure manifold chamber 90 into the first passage 88 of the piston structure 26, and from the first passage 88 into the third passage 168, and the liquid accumulator 224 connecting with the third passage 168 begins to charge. High pressure working liquid is also supplied from the first passage 88 into the upper and lower valve control chambers 206, 208, through the upper and lower needle valves 216, 220 and the passages 218, 222, respectively. Since the push rod 172 is in its lower position, the liquid within the upper valve control chamber 206 will be bled off to the return second passage 100 through the slot 186 of the push rod 172 and the upper bore hole 190, while the pressure within the lower valve control chamber 208 increases. The difference in pressure between the working liquid in the upper and lower valve control chambers 206, 208 then causes the spool 196 to move to its upper position, thereby connecting the third passage 168 to the return second passage 100. Then the hydraulic force exerted on the lower-facing surface 164 of the loading chamber 154, which is always connected to the supply first passage 88 through the two slots 166, causes the ram structure to start to move upward in its loading direction.

As the ram structure 28 moves upward within the housing member 16, the pressurized air within the housing member 16 surrounding the ram structure 28 is free to move between the upper and lower portions of the housing member 16 until the top of the ram structure enters the top compression chamber 120 and the top sealing rings 118 seal against the inner surface of the housing member 16. As the ram structure continues to move upward and into the top compression chamber 120, the check valve 134 closes, and the pressurized gas compressed therein by the ram structure 28 exerts a retarding force on the ram structure 28 which slows the ram structure, allowing the high pressure accumulators connected to the high pressure manifold chamber 90 to start to charge.

During a last portion of the upward travel of the ram structure 28, the shoulder 162, forming the top-facing surface of the firing chamber 156, engages the bottom crossarm member 182 of the push rod 172, and moves the push rod 172 to its upper position. As the push rod 172 is moved upward, its lower slot 188 is connected with the lower valve control chamber 208 and starts to bleed the working liquid therein to the return second passage 100 through the lower bore hole 191, the third passage 168, and the main valve 194. When the push rod 172 is closer to its upper position than to its lower position, the pressure within the lower valve control chamber 208 will exceed that within the upper valve control chamber 206, and the spool 196 will thereby be moved to its upper position. When the spool 194 is in its upper position, the third passage 168, connecting with the firing chamber 156 and the liquid accumulator 224, is again connected to the supply first passage 88, whereupon high pressure working liquid is admitted into the firing chamber and exerts a downward force against the top-facing shoulder 162 of the ram structure 28, to cause it to move downward in its firing direction. At the beginning of the downward travel of the ram structure, when its velocity is relatively low, the liquid accumulator 224 is fully charged by the high pressure working liquid within the third passage 168. As the ram structure 28 approaches its maximum downward velocity, the demand rate for working liquid to fill the firing chamber 156 becomes quite high, and the flow resistance through the main valve 194 increases. During this period of maximum downward velocity of the ram structure 28, the liquid accumulator 224 supplies working liquid to the firing chamber 156 through the third passage 168, to lower the demand rate for working liquid, and prevent cavitation of the working liquid within the firing chamber 156.

As previously discussed, the downward force exerted on the ram structure 28 within the firing chamber 156 is greater than the upward force exerted on the ram structure 28 within the loading chamber 154, due to the larger area of the working surface 162 within the firing chamber 156 compared with the area of the working surface 164 within the loading chamber 154.

After the ram structure 28 has moved downward out of the top compression chamber 120 and its top sealing rings 118 are disposed opposite the slots 126 of the housing member 16, the air within the housing member 16 is again free to move from under the ram structure 28 through the slots 126, 128. The air from under the ram structure 28 continues to flow through the slots 126, 128 into the chamber 120 until the ram structure 28 passes the V-seals 122. At this point the bottom compression chamber 124 is formed by the housing member 16, the ram structure 28, and the anvil structure 30. As the ram structure 28 continues to descend into the bottom compression chamber 124, its potential energy compresses the air contained therein and develops a preload force against the anvil structure 30. The preload against the anvil structure 30 begins to move the anvil structure 30 downwardly before impact occurs between the ram structure 28 and the anvil structure 30. In effect, this amounts to a reduction in the velocity of the ram structure 24. Thereafter the impact occurs against the cushion plate 40.

The reduced velocity accompanied by a preload force is a much more effective means of energy transfer than that of an ordinary load. Further, striking a softer material, that is the cushion plate 40, which is made of a soft material, such as aluminum, aids in absorbing energy from the ram structure 28 without rebounding high frequency shock waves which cause metal fatigue.

As the anvil structure 30 moves downward upon impact, the housing member 16 also moves downward until the lower surface of the shoulder 46 of the housing member 16 makes contact with the mating abutment surface 48 of the anvil block 34.

As the pile member 14 is driven downward by the anvil structure 30, the water contained within the pile member 14 flows freely out of the pile member 14 through the holes 33, thus preventing part of the impact force being uselessly expended in compressing the air within the top of the pile 14 against the water within the pile 14.

During a last portion of the downward travel of the ram structure 28, the top crossarm member 184 of push rod 172 is engaged by the bottom end 164 of the packing gland 120 disposed at the top end of the ram structure 28, and the push rod 172 is moved to its lower position, thus moving the spool 196 to its top position and thus repeating the operating cycle described above.

During the upward movement of the ram structure 28, the working liquid within the firing chamber 156 is discharged back through the third passage 168, the ports 215, the valve chamber 210, the ports 214, the second passage 100, the low pressure manifold chamber 98, and the return liquid line 102, to the hydraulic pumps 312 at the surface platform 278. The low pressure liquid accumulators 104 connected to the low pressure manifold chamber 98 reduces line shock and surges in the return liquid system.

When the water depth in which the hammer 10 must operate exceeds about 500 feet, and the hydraulic hoses from the surface platform 278 become too unwieldy to handle, the hydraulic system which is self-contained and mounted to the hammer 10, as described earlier, can be used, to eliminate the need for the supply and return hydraulic hoses. This requires only a submersible electric power cable connecting between the hammer 10 and the operating platform 278, along with the air hose 132, which is much easier to handle.

The ground, tapered surface 142 of the packing gland 120 is easily locked to the matching, ground, tapered surface 144 of the ram structure 28 by merely tapping the packing gland 120 into the ram structure 28; and is removed as previously discussed. Both of these ground, tapered surfaces 142, 144 have a taper of about 2° relative to the longitudinal axis of the stem portion 82 of the piston structure 26.

What is claimed is:

1. A hydraulic pile driving apparatus, which comprises:

an elongated tubular housing member;

closure means for sealing a top end of said tubular member;

an anvil means for sealing an opposite bottom end of said tubular member and transmitting a driving force to the pile, said anvil means being in sealing, sliding contact with said tubular member for limited motion therein, whereby said housing member, closure means and anvil means define a gas-filled chamber;

an elongated ram means, which is slidably disposed within said gas-filled chamber for movement in a generally upward loading direction to a top position and movement in an opposite, generally downward, firing direction to a bottom position, and which includes a top end surface defining an interior recessed space, and a bottom end which strikes against said anvil means when said ram means is moved to said bottom position, said ram means being supported by said anvil means when said ram means is at rest;

a piston means, which is mounted to said closure means and extends through said gas-filled chamber into said interior space of said ram means, for defining therein a loading chamber means, continuously connected to receive high pressure working liquid, for exerting a loading force on an interior bottom-facing surface of said ram means to move same upward to said top position, and a firing chamber means, alternately connected to receive high pressure working liquid for exerting a firing force on an interior, top-facing surface of said ram means to move same downward to said bottom position, and then connected to exhaust working liquid at low pressure, to permit said loading chamber means to move said ram means in said upward loading direction, the area of said top-facing surface being larger than the area of said bottom-facing surface, so that the net force exerted on said ram means when both said loading and firing chamber means are connected to receive high pressure working liquid is a force to move said ram means in said firing direction;

means for pressurizing said working liquid;

means for delivering high pressure working liquid from an outlet of said liquid pressurizing means to said piston means;

means for returning exhaust, low pressure working liquid from said piston means to an inlet of said liquid pressurizing means; and means for positioning said housing member relative to the pile to enable said anvil means to transmit said driving force to the pile.

2. A hydraulic pile driving apparatus, as described in claim 1, wherein:

said housing member includes an interior surface which defines grooves extending longitudinally along a median portion of said housing member.

3. A hydraulic pile driving apparatus, as described in claim 2, wherein:

said ram means includes an exterior side surface which also defines grooves extending longitudinally along a median portion of said ram means, whereby the gas contained within said gas-filled chamber can freely circulate around said ram means between upper and lower portions of said gas-filled chamber when said ram means is moving in a median portion of its path of travel between said top and bottom positions.

4. A hydraulic pile driving apparatus, as described in claim 1, wherein:

the bottom end of said ram means comes into sealing, sliding contact with said housing member as said ram means is moved in said firing direction and approaches said bottom position, to form a bottom gas-filled compression chamber, whereby the gas thus compressed exerts a pre-load force on said anvil means before said ram means strikes same.

5. A hydraulic pile driving apparatus, as described in claim 1, wherein:

the top end of said ram means comes into sealing, sliding contact with said housing member as said ram means is moved in said loading direction and approaches said top position, to form a top gas-filled compression chamber, whereby the gas thus compressed exerts a decelerating force on the upward-moving ram means.

6. A hydraulic pile driving apparatus, as described in claim 1, wherein said piston means comprises:

a main body portion which is in sealing, sliding contact with a longitudinally extending, inner wall of said ram means defining a portion of said interior recessed space, to separate said loading and firing chamber means; and an elongated stem portion extending from said main body portion at one end and mounted to said closure means at an opposite end, which is in sliding, sealing contact with a portion of said top end surface of said ram means defining an entrance to said interior space of said ram means, to prevent leakage of said working liquid from said loading chamber means into said gas-filled chamber.

7. A hydraulic pile driving apparatus, as described in claim 6, wherein said main body portion of said piston means comprises:

a longitudinally disposed push rod;

a main valve means slidably disposed about said push rod for limited motion along the longitudinal axis of said push rod, between a raised position and a lowered position, said main valve means connecting said firing chamber means to said exhaust liquid return means when disposed in said raised position, and said main valve means connecting said firing chamber means to said high pressure liquid delivery means when disposed in said lowered position, said main valve means having top end and bottom end portions in sliding, sealing contact with said main body portion of said piston means at all times, and said piston valve means also having an interior median portion in sliding, sealing contact with said rod at all times;

an upper valve control chamber means defined by said main body portion of said piston means, said main valve means, and said push rod, for exerting a force on a top surface of said main valve means to move same to said lowered position;

a lower valve control chamber means defined by said main body portion, said main valve means, and said push rod, for exerting a force on a bottom surface of said main valve means to move same to said raised position;

an upper needle valve means for admitting high pressure working liquid from said liquid delivery means to said upper valve control chamber; and a lower needle valve means for admitting high pressure working liquid from said liquid delivery means to said lower valve control chamber means.

8. A hydraulic pile driving apparatus, as described in claim 7, wherein said push rod is slidably disposed within said main body portion for limited motion along said longitudinal axis between a raised and a lowered position, and includes:

an upper portion and a lower portion in sliding, sealing contact with said main body portion at all times;

a top end carrying a top crossarm member which engages with said interior bottom-facing surface of said ram means as said ram means approaches its bottom position, to move said push rod to its lowered position;

a bottom end carrying a bottom crossarm member which engages with said interior top-facing surface of said ram means as said ram means approaches its top position, to move said push rod to its raised position; and a median portion, intermediate said upper and lower portion, which defines an upper, longitudinally extending, recessed space or slot therein which connects said upper control chamber means to said liquid return means as said push rod approaches its lowered position; and a lower, longitudinally extending, recessed space or slot therein which connects said lower control chamber means to said liquid return means as said push rod approaches its raised position.

9. A hydraulic pile driving apparatus, as described in claim 8, wherein said main body portion of said piston means comprises a friction holding means for maintaining said rod in its raised position during firing of said ram means until said top crossarm is engaged and moved by said ram means.

10. A hydraulic pile driving apparatus, as described in claim 6, wherein said main body portion of said piston means includes a pressurized liquid accumulator means connecting with said firing chamber means, for preventing cavitation of the working liquid within said firing chamber means and maintaining the pressure of the working liquid exerting a downward force on said ram means, by storing high pressure working liquid when said liquid is initially admitted to said firing chamber means by said piston valve means and returning said liquid to said firing chamber means when the initial pressure of the liquid within said firing chamber means decreases as said ram means approaches its maximum downward acceleration.

11. A hydraulic pile driving apparatus, as described in claim 10, wherein said liquid accumulator means comprises:

a longitudinally disposed tubular member, closed at a bottom end and connecting with said firing chamber means at an opposite top end;

a piston member, slidably disposed within said tubular member for limited motion therein along a longitudinal axis, in sliding, sealing contact with said tubular member at all times, said tubular member and piston member forming a chamber which is filled with a pressurized gas; and a holding member to prevent the force exerted by said pressurized gas from moving said piston out of said tubular member, whereby said high pressure working liquid initially moves said piston member into said tubular member against the pressure of said gas contained therein, and as the pressure of said working liquid drops during maximum acceleration of said ram means, said pressurized gas moves said piston outward to thereby maintain the pressure of the working liquid exerted against said ram means, and prevent cavitation within said firing chamber means.

12. A hydraulic pile driving apparatus, as described in claim 1, wherein said piston means comprises a main body portion and an elongated stem portion extending from said main body portion at one end and mounted to said closure means at an opposite end, and wherein said top end of said ram means includes:

a first, ground, tapered surface defining an opening to said interior recessed space, through which said stem portion of said piston means extends, said surface having an inward sloping taper of about two degrees with respect to the longitudinal axis of said stem portion; and a stem packing gland member, which has a second, tapered, ground outer surface, which also has an inward sloping taper of about two degrees with respect to its longitudinal axis, which engages the ground, tapered surface defining an opening to said interior recessed space to lock said packing gland member to said ram means by surface friction between said first and second ground, tapered surfaces.

13. A hydraulic pile driving apparatus, as described in claim 12, wherein said stem packing gland member includes:

an inner surface, to which are mounted compressible sealing rings which seal against said stem portion of said piston means;

a top, outer flange portion, adjacent a flange portion of said ram means, which defines a plurality of threaded openings therethrough, into which threaded jackoff bolts can be inserted to bear against said flange portion of said ram means; and a top, end surface which defines an annular, recessed space between said inner surface and said flange portion of said packing gland member.

14. A hydraulic pile driving apparatus, as described in claim 1, wherein said working liquid delivery means comprises:

a high pressure manifold means mounted to said closure means;

liquid accumulator means connecting with said high pressure manifold means;

conduit means connecting said high pressure manifold means to said piston means; and conduit means connecting said high pressure manifold to said means for pressurizing said working liquid.

15. A hydraulic pile driving apparatus, as described in claim 1, wherein said liquid return means comprises:

a low pressure manifold means mounted to said closure means;

liquid accumulator means connecting with said low pressure manifold means;

conduit means connecting said low pressure manifold means to said piston means; and conduit means connecting said low pressure manifold to an input of said liquid pressurizing means.

16. A hydraulic pile driving apparatus, as described in claim 1, which further comprises:

a guide sleeve fastened at the bottom end of said housing member by a plurality of fastening means, said guide sleeve extending into said housing and defining a set against which said anvil means rests.

17. A hydraulic pile driving apparatus, as described in claim 16, wherein said plurality of fastening means includes a plurality of releasable wire rope slings retained within aligned pairs of channel portions formed within said housing member and said guide sleeve at selected positions around the periphery of said housing member.

18. A hydraulic pile driving apparatus, as described in claim 17, wherein said anvil means includes an anvil block, first cushion means, an alignment plate and second cushion means, and wherein said first cushion means is received within a depression formed within the top surface of said anvil block and said second cushion means is received within a depression formed within the top surface of said alignment plate.

19. A hydraulic pile driving apparatus, as described in claim 18, wherein the depression formed within the top surface of said alignment plate includes a convex surface against which said second cushion means rests, said second cushion means being shaped to engage said convex surface.

20. A hydraulic pile driving apparatus, as described in claim 16, which further includes means to adapt same for submersible operation, which comprises:

means for supplying pressurized gas at a pressure which is always substantially equal to the pressure exerted on the lowermost portion of said guide sleeve by water in which said guide sleeve is immersed;

first conduit means for connecting said gas-filled chamber within said housing member to said pressurized gas supply means; and a first check valve means, disposed within said housing member, for preventing reverse flow of pressurized gas from said gas-filled chamber through said first conduit means.

21. A hydraulic pile driving apparatus, as described in claim 20, which further comprises:

second conduit means for connecting a top end of said guide sleeve to said pressurized gas supply means, and a second check valve, disposed within said second conduit means, for preventing reverse flow of pressurized gas from said guide sleeve through said second conduit means.

22. A hydraulic pile driving apparatus, as described in claim 20, wherein said housing member includes an interior surface which defines grooves extending longitudinally along a median portion of said housing member, and which further comprises:

conduit means for connecting the top end of said guide sleeve to one of said grooves of said housing member.

23. A hydraulic pile driving apparatus, as described in claim 20, wherein said liquid pressurizing means includes:

a frame member mounted to said housing member, which defines a gas-filled enclosure;

at least one electrically actuated hydraulic pump, mounted to said frame member within said gas-filled enclosure; and a submersible electric power cable, for supplying electric power from a surface supply to said at least one hydraulic pump.

24. A hydraulic pile driving apparatus, as described in claim 23, wherein said first conduit means includes:

said gas-filled enclosure; and a further check valve means, disposed within said frame member, for preventing reverse flow of pressurized gas from said gas-filled enclosure through said first conduit means.

25. A hydraulic pile driving apparatus, as described in claim 20, adapted for driving a pile within a selected one of a plurality of submersed, hollow, cylindrical, jacket or support legs of an offshore structure which are connected by structural members therebetween, wherein said means for positioning said housing member relative to the pile comprises a movable operating structure, which includes:

a mounting spider, having extendable mounting legs for securing said mounting spider member to the structural members of the offshore structure;

a subcarriage member, pivotably mounted to said mounting spider member;

means for pivotably moving said subcarriage member relative to said mounting spider member;

a movable platform, mounted to said subcarriage member for limited movement thereon along a longitudinal axis of said subcarriage member;

hydraulically actuated means for moving said platform in either direction along the longitudinal axis of said subcarriage member;

means for engaging said movable platform with said selected one of said plurality of support legs, mounted at one end of said movable platform;

a folding boom, pivotably mounted on said movable platform, which includes first cable sheave means rotatably mounted at a top end, and which is movable between a lowered position and an upright vertical position wherein said first cable sheave means are directly above said selected support leg engaged by said platform engaging means;

hydraulic cylinder means for pivotably moving said boom;

a frame structure, which is mounted at a bottom end to the top end of said housing member, and which includes a second cable sheave means rotatably mounted at an opposite, top end of the frame structure;

a hydraulically actuated cable hoist means, mounted on said movable platform, which includes two cable drums;

a housing support cable, attached at each end to a respective one of said cable drums, and engaging with said first and second cable sheave means therebetween;

hydraulic pump means, mounted on said movable platform, for supplying pressurized liquid to actuate said means for moving said movable platform, said hydraulic cylinder means pivoting said boom, and said cable hoist means; and guide means for centering said housing member within said selected support leg.

26. A hydraulic pile driving apparatus, as described in claim 20, wherein said guide means for centering said housing member comprises at least three spring elements fastened to, and spaced about an outer circumference of, said tubular member of said housing, at each of at least two longitudinally displaced positions along said tubular member of said housing.

27. A hydraulic pile driving apparatus, as described in claim 20, wherein said means for engaging said selected support leg comprises a semicircular shaped engaging plate means, having an inside diameter approximately equal to the outside diameter of said selected support leg.

28. A hydraulic pile driving apparatus, as described in claim 25, wherein said hydraulic pump means constitutes said means for pressurizing said working liquid, and said working liquid delivery and return means each comprise:

a hydraulic hose reel rotatably disposed on the top end of said boom;

hydraulic torque motor means for rotating and holding said hydraulic hose reel, actuated by pressurized liquid supplied by said hydraulic pump means;

a hydraulic liquid manifold means defined by a frame member mounted at the top end of said housing member, and connecting to said piston means; and a hydraulic hose, wound on said hydraulic hose reel and connecting between said hydraulic liquid manifold and said hydraulic pump means.

29. A hydraulic pile driving apparatus, as described in claim 28, wherein said means for supplying pressurized gas includes air compressing and regulating means disposed on said movable platform, and said first conduit means includes an air hose reel, rotatably mounted at the top end of said boom;

hydraulic torque means for rotating and holding said air hose reel, actuated by pressurized liquid supplied by said hydraulic pump means; and an air hose, wound on said air hose reel, and connecting between said air compressor and said gas-filled chamber within said housing member through said first check valve means.

30. In an hydraulic cylinder means having a rod member, an end structure which defines an opening therein, and a rod packing gland mounted to said end structure within said opening which includes an interior surface which seals against said rod, wherein said rod and said end structure are movable relative to one another along the longitudinal axis of said rod, the improvement which comprises:

said end structure, which includes a conical ground surface defining said opening, which is tapered inwardly along said axis from one side of said end structure to an opposite side of said end structure so that said opening is shaped as a truncated conical opening; and said packing gland, which includes an outer conical ground surface which is tapered along said axis to match and engage with the tapered conical surface of said end structure, whereby said packing gland is locked to said end structure by surface friction between the matching ground surfaces of said end structure and said packing gland.

31. The improved hydraulic cylinder means, as defined in claim 30, wherein the taper of said ground, tapered surfaces is approximately two degrees.

32. The improved hydraulic cylinder means, as defined in claim 30, which further comprises:

said end structure, which includes a flanged surface adjacent to, and surrounding said conical ground surface of said end structure, and a surface defining a necked portion between said flanged surface of said end structure and a main body portion of said end structure; and said packing gland, which includes an end flange portion defining a plurality of threaded openings therein, into which threaded jackoff bolts can be inserted for bearing against the flanged surface of said end structure, and an end surface which defines an annular recessed space between said end flange portion of said packing gland and the interior surface of said packing gland which seals against said rod.

33. A method of producing a reciprocating impact load against a pile member to be driven inside a submersed, hollow support leg of an offshore structure by a liquid actuated pile member driving hammer, which comprises the steps of:

inserting the pile member within the support leg and supporting the pile member in position to be driven;

inserting the hammer into the support leg and positioning the hammer in a position for delivering to the pile member a reciprocating impact load by a load delivering member displaceable within the hammer, continuously supplying a pressurized gas to chamber means of the hammer within which said load delivering member is to be reciprocated, and to a guide sleeve of the hammer used in the step of positioning the hammer, at a pressure substantially equal to the pressure exerted on the lowermost portion of the hammer by water surrounding it, to prevent entrance of the water into the hammer, and to displace the water from the area immediately surrounding the plane of engagement of the pile member and a load transferring member;

directing a pressurized working liquid only against a first interior surface of the load delivering member to cause the load delivering member to move in a first direction;

compressing the gas within a first end of the chamber means to decelerate movement of the load delivery means in the first direction;

directing the pressurized working liquid against a second interior surface of the load delivering member, of larger area than the first interior surface, while continuing to direct the pressurized working liquid against the first interior surface to cause the load delivering member to move in a second, opposite direction and strike against the load transferring member;

compressing the gas within a second opposite end of the chamber means to preload the load delivering member; and repeating the step of directing a pressurized working liquid only against a first interior surface of the load delivering member.

34. A method of removing a rod packing gland from a hydraulic cylinder member to which the gland is mounted by surface friction between mating conical tapered surfaces, commonly known as a locking taper joint, which comprises the steps of:

inserting a plurality of jackoff screws into threaded holes defined within a top end flanged portion of the packing gland, and tightening the jackoff screws to exert a force against an adjacent flanged area of the hydraulic cylinder member;

applying heat to the mating locked surfaces of the cylinder member and the packing gland, to expand both locked surfaces;

pouring cold water into an annular-shaped cavity of the packing gland defined by the top surface of the packing gland, between the flanged portion of the packing gland and an interior surface of the packing gland in sealing contact with a rod member of the hydraulic cylinder, which contracts the locked surface of the packing gland, and thus allows the force exerted by the jackoff screws to free the packing gland from the hydraulic cylinder member.

* * * * *